US008037694B2

(12) United States Patent
Runbalk

(10) Patent No.: US 8,037,694 B2
(45) Date of Patent: Oct. 18, 2011

(54) FLOATING SYSTEM FOR LIQUEFYING NATURAL GAS

(75) Inventor: David Bertil Runbalk, The Hague (NL)

(73) Assignee: Shell Oil Company, Houston, TX (US)

( * ) Notice: Subject to any disclaimer, the term of this patent is extended or adjusted under 35 U.S.C. 154(b) by 0 days.

(21) Appl. No.: 10/489,496

(22) PCT Filed: Sep. 13, 2002

(86) PCT No.: PCT/EP02/10367

§ 371 (c)(1),
(2), (4) Date: Mar. 30, 2004

(87) PCT Pub. No.: WO03/023302

PCT Pub. Date: Mar. 20, 2003

(65) Prior Publication Data

US 2005/0005615 A1 Jan. 13, 2005

(30) Foreign Application Priority Data

Sep. 13, 2001 (EP) ..... 01307816

(51) Int. Cl.
*F17C 9/02* (2006.01)

(52) U.S. Cl. ..... 62/50.2; 62/611; 62/612; 62/613

(58) Field of Classification Search ..... 62/50.2, 62/611, 612, 613
See application file for complete search history.

(56) References Cited

U.S. PATENT DOCUMENTS

| | | | | |
|---|---|---|---|---|
| 3,342,037 | A * | 9/1967 | Ludwig | 62/612 |
| 3,766,583 | A | 10/1973 | Phelps | |
| 4,017,283 | A * | 4/1977 | Witt | 62/623 |
| 4,041,721 | A | 8/1977 | Kniel | 62/45 |
| 4,575,281 | A * | 3/1986 | Oksuzler | 405/217 |
| 5,036,671 | A * | 8/1991 | Nelson et al. | 62/612 |
| 5,916,260 | A | 6/1999 | Dubar | 62/613 |
| 6,047,747 | A * | 4/2000 | Bowen et al. | 141/231 |
| 6,085,528 | A | 7/2000 | Woodall et al. | 62/45.1 |
| 6,089,022 | A | 7/2000 | Zednik et al. | 60/641.7 |
| 6,094,937 | A * | 8/2000 | Paurola et al. | 62/613 |
| 6,250,244 | B1 * | 6/2001 | Dubar et al. | 114/264 |
| 6,658,891 | B2 * | 12/2003 | Reijnen et al. | 62/612 |
| 6,743,829 | B2 * | 6/2004 | Fischer-Calderon et al. | 518/700 |
| 2002/0170297 | A1 * | 11/2002 | Quine et al. | 62/50.2 |
| 2005/0005615 | A1 | 1/2005 | Runbalk | |

FOREIGN PATENT DOCUMENTS

| | | |
|---|---|---|
| DE | 3200958 | 7/1983 |
| EP | 0500355 | 8/1992 |
| WO | 99/38762 | 8/1999 |
| WO | 00/36334 | 6/2000 |

OTHER PUBLICATIONS

International Search Report dated Feb. 7, 2003.
Hanawa, K., et al "An experimental study of float type LNG terminal", Twelfth Intl Conference and Exhibition on Liquefied Natural Gas, Perth, Australia, May 1998, p. 5.7-1-5.7-15.
OTC paper No. 3956, Kennett A.J., e al., "Offshore liquefactio of associated gas, a suitable process for the North Sea", 1981.

* cited by examiner

*Primary Examiner* — Frantz F Jules
*Assistant Examiner* — Azim Rahim

(57) ABSTRACT

A floating system for liquefying natural gas comprising a vessel provided with a plant for liquefying natural gas having an inlet for natural gas and an outlet for liquefied natural gas, a feed supply system for supplying natural gas to the inlet of the plant, one or more storage tanks for storing liquefied natural gas, and an off-loading system for transporting liquefied natural gas between the storage tank(s) and a tanker, which floating system further comprises a vaporization system having an inlet for liquefied gas and an outlet for vapor.

32 Claims, 2 Drawing Sheets

FLOATING SYSTEM FOR LIQUEFYING NATURAL GAS

Figure 1:
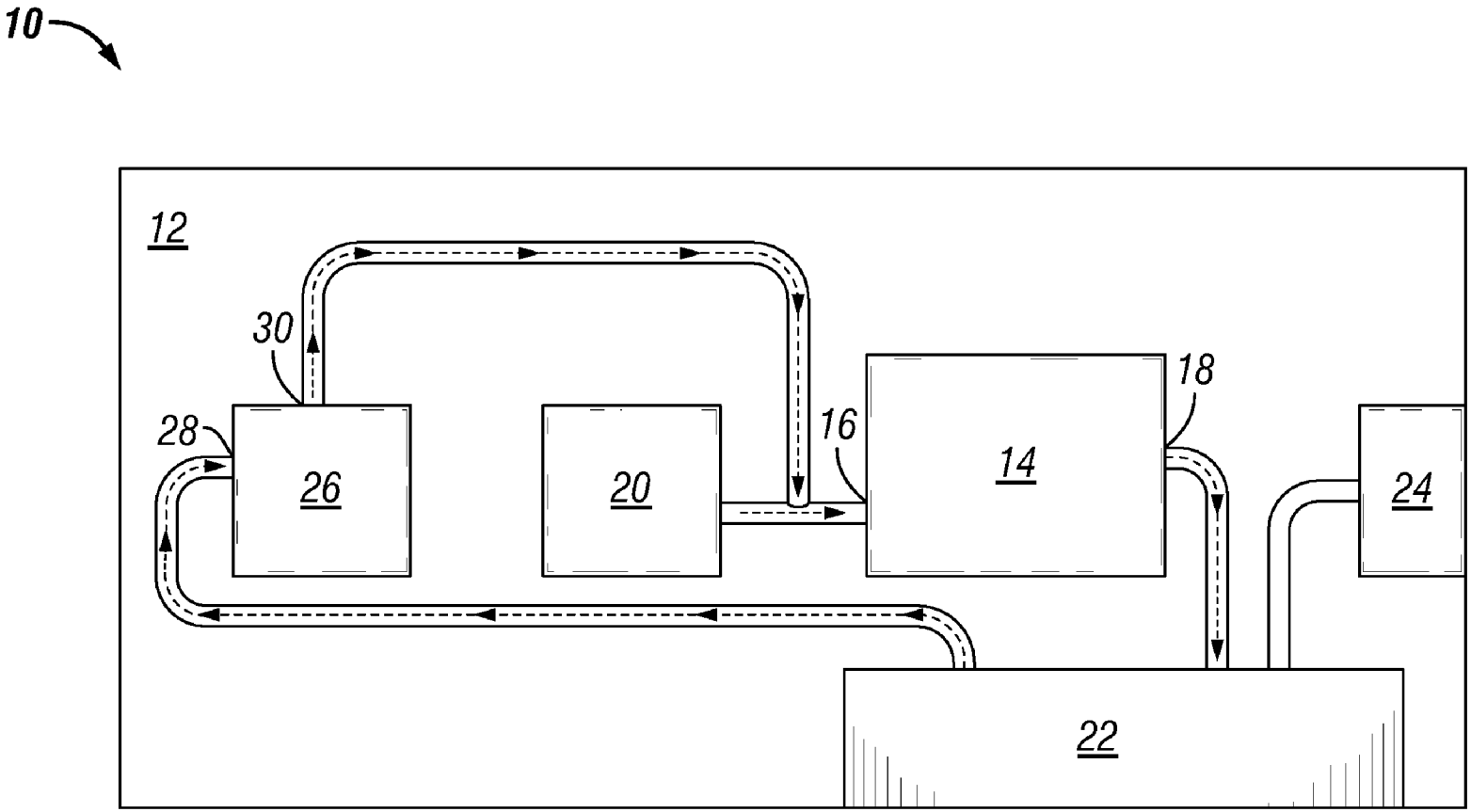

The present invention relates to a floating system for liquefying natural gas. Such a system comprises a vessel provided with a plant for liquefying natural gas, a feed supply system for supplying natural gas to the plant, one or more storage tanks for storing liquefied natural gas and an off-loading system for delivering liquefied natural gas from the storage tanks to a tanker. An example of such a system is described in the presentation by Hanawa, K, et al, "An experimental study of float type LNG terminal", Twelfth International Conference and Exhibition on Liquefied Natural Gas, Perth, Australia, May 1998, page 5.7-1 through 5.7-15.

Suitably the plant includes treating units for removing water and other contaminants, such as hydrogen sulphide and carbon dioxide from the gas before liquefaction.

Examples of plants for liquefying natural gas that can be used are given in OTC paper No. 3956, Kennett, A J,. et al, Offshore liquefaction of associated gas, a suitable process for the North Sea, 1981.

The floating system allows economic production of natural gas that is contained in remote offshore fields. In order to produce such a field a well is made that has a wellhead located on the sea bottom. A flow line connects the underwater wellhead to the feed supply system of the floating system. The natural gas produced from the well is liquefied in the known way, and the liquefied natural gas is stored in the storage tank(s) of the vessel. At regular intervals a suitable tanker is moored to the vessel and it is connected to the off-loading system to receive the liquefied natural gas. After being filled, the tanker brings the liquefied natural gas to shore. Alternatively, the wellhead is located on a production platform and a flow line connects the wellhead to the feed supply system of the floating system.

Offshore plants for liquefying natural gas have been developed from onshore plants. There is however a major difference between the two and that resides in the construction. An onshore plant is constructed at the production location, which is the location where liquefied natural gas is to be produced. In contrast thereto, the floating system containing the offshore plant is constructed at a suitable construction location and then towed to an offshore production location where liquefied natural gas is to be produced.

This difference has a major impact on commissioning the liquefaction plant. When a pipeline providing the natural gas is available, an onshore plant can be commissioned after construction using the gas that is supplied through the pipeline. This can be done as well for an offshore plant. However, it implies that the system has to be towed to the production location before commissioning.

Applicant considered this to be impractical because the production location is far away from the construction location, so that it is not easy to do any work on the system for example to correct shortcomings unearthed in the commissioning.

Therefore, it is an object of the present invention to provide a floating system for liquefying natural gas that can be commissioned at any location, for example the construction location.

To this end the floating system for liquefying natural gas according to the present invention comprises a vessel provided with a plant for liquefying natural gas having an inlet for natural gas and an outlet for liquefied natural gas, a feed supply system for supplying natural gas to the inlet of the plant, one or more storage tanks for storing liquefied natural gas, and an off-loading system for transporting liquefied natural gas between the storage tank(s) and a tanker, which floating system further comprises a vaporization system having an inlet for liquefied gas and an outlet for vapour.

Suitably the inlet of the vaporization system is connected to the tanks for storing liquefied natural gas. Suitably the outlet of the vaporization system can be connected to the inlet of the plant for liquefying natural gas or to the feed supply system.

In order to commission the floating system for liquefying natural gas according to the present invention, a tanker filled with liquefied natural gas is moored to the vessel, and the off-loading system is used to pump at least part of the liquefied natural gas from the tanker into at least one of the storage tanks of the floating system. Liquefied natural gas from the storage tank is then supplied to the vaporization system that produces vapour, and vaporized natural gas is supplied to the liquefaction plant. The plant is brought into production, and as long as the temperature of the fluid exiting the plant is not low enough, the fluid can be recycled to the inlet of the liquefaction plant.

In this way the floating system can be commissioned at a location that is not the production location.

Providing the floating system with a vaporization system has further advantages. In case of fluctuating supply of natural gas from the wells, the feed to the plant can be kept at a constant level by supplying natural gas that is obtained by vaporizing part of the liquefied natural gas that is stored in the storage tanks.

In some cases the well producing natural gas is close to an oil-producing well, and then the gas that is produced by the vaporization system can be used to enhance production of oil from the oil-producing well by injecting the gas into the reservoir or by applying gas lift. In other cases, the gas to be liquefied is produced as associated gas, that is natural gas dissolved in the oil at reservoir conditions or natural gas that forms a gas cap above the crude oil in the reservoir, and also in this case the vaporization system can be used to enhance the production. An advantage of using the vaporized gas is that it is free from contaminants.

There are locations where it is economically attractive to transport part of the natural gas that is produced to shore for domestic use. In case the production of natural gas drops, for example because of a problem related to the well, the supply of domestic gas can be maintained at the required level by vaporizing stored liquefied natural gas using the vaporization system.

The vaporization system draws liquefied natural gas from the storage tank(s) and pumps it to a pressure sufficient for the aforementioned uses. For example, for commissioning or plant re-starting purposes a pressure slightly above the liquefaction plant inlet pressure of approximately 50 to 65 bar would be required. In that case a gas compressor will be added.

The vaporization system comprises one or more vaporizers, in which the liquefied natural gas is boiled to the gaseous state by heating. Several types of vaporizers can be used as appropriate, including but not limited to the following types: (1) a vaporizer of the submerged combustion type, in which liquefied natural gas is heated whilst flowing through coils or conduits immersed in a water bath which is heated by combustion of fuel; (2) a vaporizer of the intermediate fluid type in which both liquefied natural gas and the heating medium (typically seawater) flow through separate coils or conduits, both immersed in an intermediate fluid (typically liquid propane), which serves as a heat transfer medium; and (3) a vaporizer of the open rack type, comprising of a system of flow passages, in which liquefied natural gas flows, placed in a stream of heating fluid (typically seawater).

The capacity of the vaporization system is suitably in the range of from 30 to 60% of the throughput of the liquefaction plant.

Figure 2:
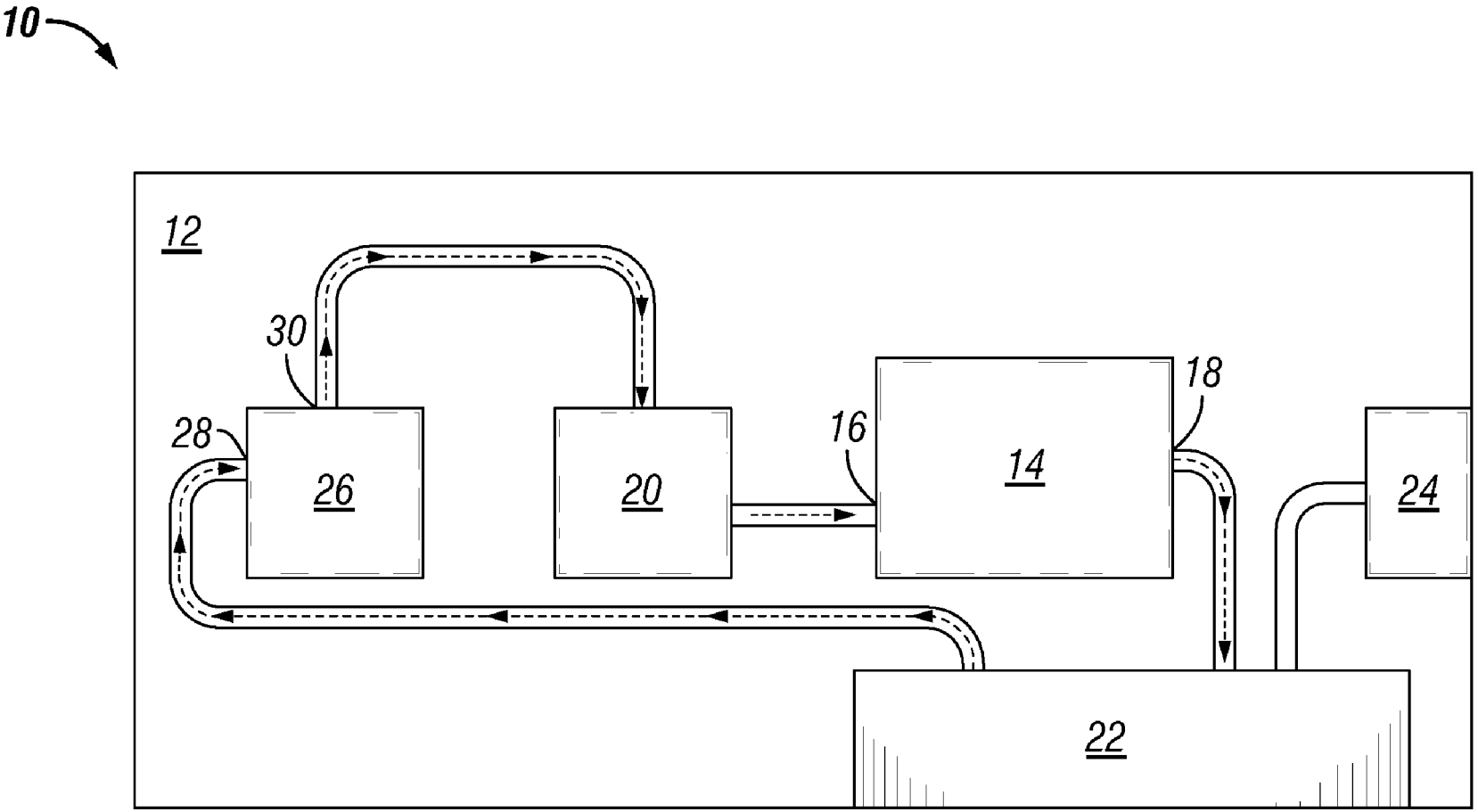

Example embodiments of the present invention will now be described by way of example only, and with reference to the accompanying drawings, wherein:

FIG. 1 and FIG. 2 are schematics of example embodiments in accordance with the present invention.

FIG. 1 and FIG. 2 show a floating system 10 for liquefying natural gas according to example embodiments of the present invention comprising a vessel 12 provided with a plant 14 for liquefying natural gas having an inlet 16 for natural gas and an outlet 18 for liquefied natural gas, a feed supply system 20 for supplying natural gas to the inlet 16 of the plant 14, one or more storage tanks 22 for storing liquefied natural gas, and an off-loading system 24 for transporting liquefied natural gas between the storage tank(s) 22 and a tanker (not shown), which floating system 10 further comprises a vaporization system 26 having an inlet 28 for liquefied gas and an outlet 30 for vapour. Suitably the inlet 28 of the vaporization system 26 is connected to the tanks 22 for storing liquefied natural gas. Suitably the outlet 30 of the vaporization system 26 can be connected to the inlet 16 of the plant 14 for liquefying natural gas (FIG. 1) or to the feed supply system 20 (FIG. 2).

I claim:

1. A floating system for liquefying natural gas comprising a vessel provided with a plant for liquefying natural gas having an inlet for natural gas and an outlet for liquefied natural gas, a feed supply system for supplying the natural gas to the inlet of the plant, at least one tank for storing the liquefied natural gas, and an off-loading system for transporting the liquefied natural gas between the at least one storage tank and a tanker, wherein the floating system further comprises a vaporization system having an inlet for liquefied natural gas and an outlet for natural gas, wherein the inlet of the vaporization system is connected to the at least one tank for storing liquefied natural gas, wherein the outlet of the vaporization system is connected to the feed supply system, and wherein the vaporization system vaporizes liquefied natural gas from the at least one storage tank to natural gas.

2. A floating system for liquefying natural gas comprising a vessel provided with a plant for liquefying natural gas having an inlet for natural gas and an outlet for liquefied natural gas, a feed supply system for supplying the natural gas to the inlet of the plant, at least one storage tank for storing the liquefied natural gas, and an off-loading system for transporting the liquefied natural gas between the at least one storage tank and a tanker, wherein the floating system further comprises a vaporization system having an inlet for liquefied natural gas and an outlet for natural gas, wherein the inlet of the vaporization system is connected to the tank(s) for storing liquefied natural gas, and wherein the outlet of the vaporization system is connected to the inlet of the plant for liquefying natural gas and wherein the vaporization system vaporizes liquefied natural gas from the at least one storage tank to natural gas.

3. The floating system of claim 1 wherein the vaporization system comprises one or more vaporizers, in which the liquefied natural gas is boiled to the gaseous state by heating.

4. The floating system of claim 2 wherein the vaporization system comprises one or more vaporizers, in which the liquefied natural gas is boiled to the gaseous state by heating.

5. The floating system of claim 1 wherein the vaporization system is in the range of from 30 to 60% of the throughput of the liquefaction plant.

6. A process comprising commissioning a floating system for liquefying natural gas at a location that is not the production location, wherein the floating system comprises a vessel provided with a plant for liquefying natural gas having an inlet for natural gas and an outlet for liquefied natural gas, a feed supply system for supplying the natural gas to the inlet of the plant, at least one storage tanks for storing the liquefied natural gas, and an off-loading system for transporting the liquefied natural gas between the at least one storage tank and a tanker, wherein the floating system further comprises a vaporization system having an inlet for liquefied natural gas and an outlet for natural gas, wherein the inlet of the vaporization system is connected to the at least one tank for storing liquefied natural gas, wherein the outlet of the vaporization system is connected to the inlet of the plant for liquefying natural gas, and wherein the vaporization system vaporizes liquefied natural gas from the at least one storage tank to natural gas.

7. A process comprising commissioning a floating system for liquefying natural gas at the construction location of the floating system, wherein the floating system comprises a vessel provided with a plant for liquefying natural gas having an inlet for natural gas and an outlet for liquefied natural gas, a feed supply system for supplying the natural gas to the inlet of the plant, at least one storage tank for storing the liquefied natural gas, and an off-loading system for transporting the liquefied natural gas between the at least one storage tank and a tanker, wherein the floating system further comprises a vaporization system having an inlet for liquefied natural gas and an outlet for natural gas, wherein the inlet of the vaporization system, is connected to the at least one tank for storing liquefied natural gas, wherein the outlet of the vaporization system is connected to the inlet of the plant for liquefying natural gas, and wherein the vaporization system vaporizes liquefied natural gas from the at least one storage tank to natural gas.

8. The floating system of claim 2 wherein the vaporization system is in the range of from 30 to 60% of the throughput of the liquefaction plant.

9. The process of claim 6 wherein the vaporization system comprises one or more vaporizers, in which the liquefied natural gas is boiled to the gaseous state by heating.

10. The process of claim 7 wherein the vaporization system comprises one or more vaporizers, in which the liquefied natural gas is boiled to the gaseous state by heating.

11. The process of claim 6 wherein the vaporization system is in the range of from 30 to 60% of the throughput of the liquefaction plant.

12. The process of claim 7 wherein the vaporization system is in the range of from 30 to 60% of the throughput of the liquefaction plant.

13. A process for liquefying natural gas comprising providing a floating system for liquefying natural gas comprising a vessel provided with a plant for liquefying natural gas having an inlet for natural gas and an outlet for liquefied natural gas, a feed supply system for supplying the natural gas to the inlet of the plant, at least one storage tank for storing the liquefied natural gas, and an off-loading system for transporting the liquefied natural gas between the at least one storage tank and a tanker, wherein the floating system further comprises a vaporization system having an inlet for liquefied natural gas and an outlet for natural gas, wherein the inlet of the vaporization system is connected to the at least one tank for storing liquefied natural gas, wherein the outlet of the vaporization system is connected to the feed supply system, and further comprising liquefying natural gas wherein the vaporization system vaporizes liquefied natural gas from the at least one storage tank to natural gas.

14. A process for liquefying natural gas comprising providing a floating system for liquefying natural gas comprising a vessel provided with a plant for liquefying natural gas having an inlet for natural gas and an outlet for liquefied natural gas, a feed supply system for supplying the natural gas to the inlet of the plant, at least one storage tank for storing the liquefied natural gas, and an off-loading system for transporting the liquefied natural gas between the at least one storage tank and a tanker, wherein the floating system further comprises a vaporization system having an inlet for liquefied natural gas and an outlet for natural gas wherein the inlet of the vaporization system is connected to the at least one tank for storing the liquefied natural gas, and wherein the outlet of the vaporization system is connected to the inlet of the plant for liquefying natural gas, and further comprising liquefying the natural gas wherein the vaporization system vaporizes liquefied natural gas from the at least one storage tank to natural gas.

15. The process of claim 13 wherein the vaporization system comprises one or more vaporizers, in which the liquefied natural gas is boiled to the gaseous state by heating.

16. The process of claim 14 wherein the vaporization system comprises one or more vaporizers, in which the liquefied natural gas is boiled to the gaseous state by heating.

17. The process of claim 13 wherein the vaporization system is in the range of from 30 to 60% of the throughput of the liquefaction plant.

18. The process of claim 14 wherein the vaporization system is in the range of from 30 to 60% of the throughput of the liquefaction plant.

19. A process comprising commissioning a floating system for liquefying natural gas at a location that is not the production location, wherein the floating system comprises a vessel provided with a plant for liquefying natural gas having an inlet for natural gas and an outlet for liquefied natural gas, a feed supply system for supplying the natural gas to the inlet of the plant, at least one storage tank for storing the liquefied natural gas, and an off-loading system for transporting the liquefied natural gas between the at least one storage tank and a tanker, wherein the floating system further comprises a vaporization system having an inlet for liquefied natural gas and an outlet for natural gas, wherein the inlet of the vaporization system is connected to the at least one tank for storing liquefied natural gas, wherein the outlet of the vaporization system is connected to the feed supply system, and wherein the vaporization system vaporizes liquefied natural gas from the at least one storage tank to natural gas.

20. The process of claim 19 wherein the vaporization system comprises one or more vaporizers, in which the liquefied natural gas is boiled to the gaseous state by heating.

21. The process of claim 19 wherein the vaporization system is in the range of from 30 to 60% of the throughput of the liquefaction plant.

22. A process comprising commissioning a floating system for liquefying natural gas at the construction location of the floating system, wherein the floating system comprises a vessel provided with a plant for liquefying natural gas having an inlet for natural gas and an outlet for liquefied natural gas, a feed supply system for supplying the natural gas to the inlet of the plant, at least one storage tank for storing the liquefied natural gas, and an off-loading system for transporting the liquefied natural gas between the storage tank(s) and a tanker, wherein the floating system further comprises a vaporization system having an inlet for liquefied natural gas and an outlet for natural gas, wherein the inlet of the vaporization system is connected to the at least one tank for storing liquefied natural gas, wherein the outlet of the vaporization system is connected to the feed supply system, and wherein the vaporization system vaporizes liquefied natural gas from the at least one storage tank to natural gas.

23. The process of claim 22 wherein the vaporization system comprises or more vaporizers, in which the liquefied natural gas is boiled to the gaseous state by heating.

24. The process of claim 22 wherein the vaporization system is in the range of from 30 to 60% of the throughput of the liquefaction plant.

25. The floating system of claim 1, wherein the vaporization system pumps the liquefied natural gas to a pressure.

26. The floating system of claim 2, wherein the vaporization system pumps the liquefied natural gas to a pressure.

27. The floating system of claim 6, wherein the vaporization system pumps the liquefied natural gas to a pressure.

28. The floating system of claim 7, wherein the vaporization system pumps the liquefied natural gas to a pressure.

29. The floating system of claim 13, wherein the vaporization system pumps the liquefied natural gas to a pressure.

30. The floating system of claim 14, wherein the vaporization system pumps the liquefied natural gas to a pressure.

31. The floating system of claim 19, wherein the vaporization system pumps the liquefied natural gas to a pressure.

32. The floating system of claim 22, wherein the vaporization system pumps the liquefied natural gas to a pressure.

* * * * *